United States Patent [19]

Ooms et al.

[11] 4,159,438

[45] Jun. 26, 1979

[54] ELECTRIC HALOGEN INCANDESCENT LAMP

[75] Inventors: Leon F. M. Ooms; Robertus P. C. Van Tulden, both of Eindhoven, Netherlands

[73] Assignee: U.S. Philips Corporation, New York, N.Y.

[21] Appl. No.: 885,301

[22] Filed: Mar. 10, 1978

[30] Foreign Application Priority Data

May 24, 1977 [NL] Netherlands ..... 7705668

[51] Int. Cl.[2] ..... H01K 5/02

[52] U.S. Cl. ..... 313/222; 313/333

[58] Field of Search ..... 313/222, 315, 333, 344

[56] References Cited

U.S. PATENT DOCUMENTS 3,470,410 9/1969 Patsch ..... 313/315 X

*Primary Examiner*—Rudolph V. Rolinec
*Assistant Examiner*—Darwin R. Hostetter
*Attorney, Agent, or Firm*—Robert S. Smith

[57] ABSTRACT

Lamps having a gas filling containing bromine and hydrogen can be given a very long life without the addition of iodine to the gas filling by constructing and proportioning the internal tungsten current supply conductors according to the invention.

The internal current supply conductors consist of a tungsten wire around the end of which a tungsten wire is wound helically having turns axially interspersed with the end turns of the filament.

1 Claim, 3 Drawing Figures

ELECTRIC HALOGEN INCANDESCENT LAMP

The invention relates to an electric halogen incandescent lamp having a tubular lamp envelope which is sealed at each end in a vacuum-tight manner around a respective current supply conductor, a tungsten filament which is stretched axially in the lamp envelope and which is connected to the current supply conductors which consist of tungsten at least in the region of the connection, and a gas filling comprising hydrogen and bromine.

Such an incandescent lamp is disclosed in U.S. Pat. No. 3,470,410. In this lamp a double-coiled filament is used which has single-coiled limbs of which continue into the wall of the lamp envelope. In so far as the limbs are enclosed in the wall they surround a tungsten current supply conductor. Tungsten wire is further wound around the limbs of the filament.

The object of this construction is flexibility and strength of the suspension of the filament and also to prevent attack of the limbs of the filament to maximize the filament life.

However, the known construction cannot be used in those cases in which it is desired that the current supply conductors in the lamp envelope are to extend into the turns of the filament, for example, when using single-coiled filaments.

In commercially available flood-light lamps the current supply conductor consists of a tungsten wire over the part extending into the lamp vessel, which wire is wound helically at one end and is screwed with said end into the filament in accordance with the construction according to U.S. Pat. Spec. No. 3,376,460. In those lamps the gas filling is an inert gas, bromine, hydrogen and iodine. This latter component is present because if, in addition to an inert gas, only bromine and hyrogen were present, attack of the current supply conductor would occur which gives rise to fracture. The use of iodine and the apportioning of the correct quantity thereof, however, presents great problems in the production of lamps. It is therefore endeavoured to manufacture lamps having a long (for example, 2,000 hours or more) calculated life in spite of the absence of iodine in the gas filling.

A current supply conductor having a diameter corresponding to the inside diameter of the filament could be inserted into the filament in order to achieve that attack of the current supply conductor, as it occurs in the commercially available lamps when using inert gas, hydrogen and bromine, does not result in fracture within the calculated life. Experiments have shown however, that in this event dendritic tungsten growth occurs on the turns of the filament adjoining the turns surrounding the current supply conductor as a result of transport of tungsten from the supply conductor. As a result of this, turns of the filament can be short-circuited and hence the filament is overloaded.

It is the object of the invention to provide lamps of the kind mentioned in the preamble in which a reduction of the life as a result of undesired tungsten transport is avoided.

In lamps according to the invention this object is achieved in that the current supply conductors each extend into the turns in the respective ends of the filament and have a diameter of 400 to 800 μm, in that a tungsten wire having a diameter of 300 to 100 μm is wound helically on the end of each current supply conductors inside the filament, the turns of said tungsten wire engaging the end turns of the filament.

The lamps according to the invention will be used in general as flood-light lamps or as heat radiators. During operation at the design voltage they consume a power in the range of approximately 750 to approximately 2000 watts, typically 1000, 1500 or 2000 watts. They have a very long life, as a rule 2000 hours or more.

It has been found that the construction according to the invention provides a reliable solution for the problem described. Although attack of the current supply conductor by the aggressive halogen is not prevented in the lamps according to the invention the thick current supply conductor is present at the area where the attack occurs and said conductor has such a diameter that attack cannot result in fracture. On the other hand the construction ensures that no annoying tungsten transport occurs in the axial direction of the filament. As a result of this, formation of dentrites on the turns of the filament which results in shortcircuit is prevented.

It is to be noted that a tungsten-iodine lamp or a tungsten-bromine-cycle lamp is known from U.S. Pat. Spec. No. 3,760,217. In said lamp a wire is wound around one end of a current supply conductor, which end engages the turns of a filament. However, the construction of the known lamp is different from that of the lamp according to the invention and serves a quite different purpose. In the known lamp, both current supply conductors are led through the wall of the lamp envelope at one end. One current supply conductor is connected to the filament in the above-described manner, the other extends along the wall of the tubular lamp envelope towards the other end of the filament. Said current supply conductor is enveloped substantially throughout its length by an insulating sheath. With its end projecting beyond the filament the wire wound around the first current supply conductor is wound around the insulating sheath of the other current supply conductor so as to obtain a mechanically rigid assembly. The end of the other current supply conductor is wound helically and is screwed into the other end of the filament. A wire is inserted in said helically wound end, which wire does not pass current and which at its free end is fixed in the exhaust tube seal so as to center the filament. That the prevention of attack of the current supply conductors in the known lamp forms no characteristic feature appears from the fact that mixture of argon and nitrogen having additions of iodine or bromine are used as a filling gas: with iodine substantially no attack occurs, whereas with bromine alone only very short-life-lamps (a few tens of hours) can be realized.

An incandescent lamp is furthermore known from U.S. Pat. Spec. No. 2,449,679 in which a thick wire around which a thin wire is wound is used as a screw-type mandrel. However, this known lamp is not a halogen lamp but even if it were, the construction of the known lamp would not meet the end in view. In fact, in the known lamp a number of turns of the filament at some distance from the end thereof are stretched to form a substantially straight wire section. The screw mandrel is screwed into the non-deformed turns which are separated from the filament by the said wire section. Were the said lamp a halogen lamp, attack resulting in fracture would still have occurred at the said wire section.

The length of the wire-wound end of a current supply conductor which extends into the filament of lamps according to the invention is not critical. For structural reasons the current supply conductor will as a rule extend into the filament by at least 1.5 mm. On the other hand there is no reason for this part to be chosen longer than 4 mm. Also, there is no practical reason to cause the wire wound around the current supply conductor to extend farther towards the wall of the lamp envelope than the end turn of the filament. If desired, the wire wound around the current supply conductor may extend a few turns beyond the end of the current supply conductor in the filament.

Embodiments of lamps according to the invention will now be described in greater detail with reference to the FIGS. and the examples.

Figure 1:
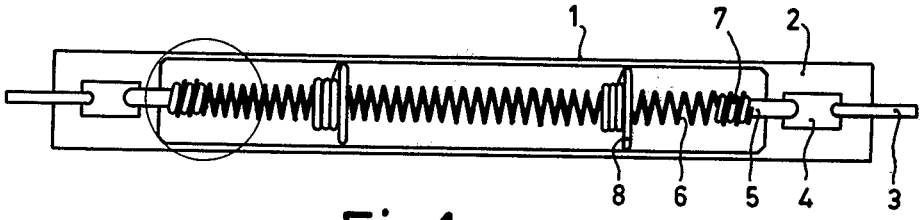
FIG. 1 is the elevation of a lamp according to the invention.

In FIG. 1, a quartz glass lamp envelope 1 is sealed at each end by means of a respective pinch seal 2 through which a current supply conductor is passed, the conductor consisting of an external molybdenum current conductor 3, a molybdenum foil 4, and an internal current conductor 5 of tungsten having a diameter of 400 to 800 μm. At its end situated inside the lamp envelope a tungsten wire 7 having a diameter of 100 to 300 μm, is wound around the current conductor 5 and engages the end turns of the filament 6. Supporting members 8 are present to support the filament.

Figure 2:
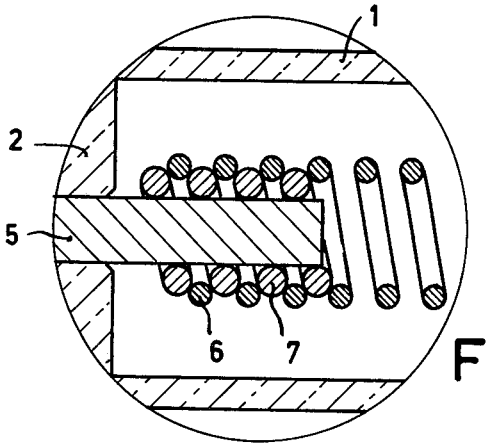
FIG. 2 is an axial sectional view of a part of the lamp shown in FIG. 1.

FIG. 2 is a sectional view on an enlarged scale of a detail of the lamp shown in FIG. 1.

Figure 3:
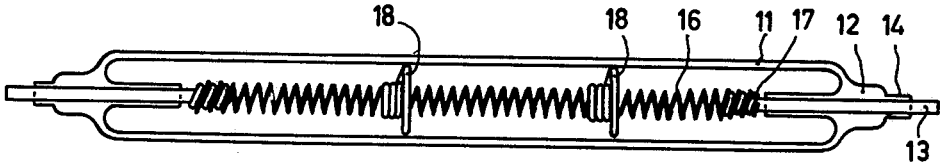
FIG. 3 is an elevation of a modified. embodiment of the lamp shown in FIG. 1.

FIG. 3 shows a lamp having a hard glass lamp envelope 11. A tungsten current supply conductor 13 is passed through the end seal 12 in a vacuum-tight manner. From within to without the lamp envelope the current supply conductor 13 is surrounded by a hard glass coating 14. Turns 17 of tungsten wire are provided on the inner end of the current supply conductor with which the conductor 13 is screwed into the end turns of the filament 16. Supports 18, of tungsten wire, support and center the filament 16.

EXAMPLE (1) A single-coiled tungsten filament is axially stretched between tungsten current supply conductors in a quartz glass tube having an inside diameter of 7.4 mm and a capacity of 6.1 $cm^3$. At their ends the current supply conductors are wound with tungsten wire over a length of 2mm, the ends of said tungsten wire entirely engaging the end turns of the filament. The lamp envelope is filled with 2.5 atmospheres argon to which 0.3% by volume of $CH_2Br_2$ has been added.

Said lamp was made in the following constructions (ϕ means the diameter of):

| Filament | | ϕ current supply conductor μm | ϕ wire on current supply conductor μm |
|---|---|---|---|
| ϕ wire μm | ϕ turns internal μm | | |
| 196.36 | 950 | 500 | 240 |
| 196.36 | 950 | 650 | 170 |
| 196.36 | 950 | 800 | 110 |
| 196.36 | 950 | 400 | 290 |

During operation at design voltage (225 volts) the lamps consume 1000 watts power and have a colour temperature of 3100° Kelvin.

(2) The corresponding data on filament and current conductor of comparable lamps having different power values (at 225 volts) are:

| | Filament | | ϕ current supply conductor μm | ϕ wire on current supply conductor μm |
|---|---|---|---|---|
| | ϕ wire μm | ϕ turns internal μm | | |
| 1500 | 246.51 | 1000 | 600 | 243 |
| 2000 | 312.06 | 925 | 700 | 167 |

What is claimed is:

1. An electric halogen incandescent lamp which comprises an elongated tubular lamp envelope having first and second ends, first and second elongated current supply conductors disposed respectively in said first and second ends of said envelope, a vacuum tight seal disposed around each end of said current supply conductors which extends to said envelope, a coiled tungsten filament disposed within said lamp envelope with the geometric axis thereof disposed in an aligned relationship to the geometric axis of said envelope, each end of said filament being helically shaped and having an axial portion surrounding an axial portion of one of said current supply conductors, said current supply conductors consisting of tungsten at least proximate to said filament, said current supply conductors having a diameter of 400 to 800 microns, said lamp further including a gas filling comprising hydrogen and bromine disposed in said envelope, and first and second tungsten wires each having a diameter of 300 to 100 microns and a helical form, said first tungsten wire engaging said first end of said filament and said first elongated current supply conductor, said second tungsten wire engaging said second end of said filament and second elongated current supply conductor, said first and second wires each being disposed in coaxial relationship to the current supply conductors and the end of said filament with which it is engaged, each of a plurality of turns of said first and second tungsten wires being disposed axially intermediate two turns of said filament in said axial portion of said filament which surround an axial portion of said current supply conductors.

* * * * *